US010604726B2

(12) United States Patent
Rischmiller et al.

(10) Patent No.: US 10,604,726 B2
(45) **Date of Patent: *Mar. 31, 2020**

(54) ENZYME-CONTAINING DETERGENT AND PRESOAK COMPOSITION AND METHODS OF USING

(71) Applicant: Ecolab USA Inc., Saint Paul, MN (US)

(72) Inventors: Michael S. Rischmiller, Saint Paul, MN (US); Kim R. Solomon, Saint Paul, MN (US); Sara Peters, Saint Paul, MN (US); Steven E. Lentsch, Saint Paul, MN (US)

(73) Assignee: Ecolab USA Inc., Saint Paul, MN (US)

( * ) Notice: Subject to any disclaimer, the term of this patent is extended or adjusted under 35 U.S.C. 154(b) by 120 days.

This patent is subject to a terminal disclaimer.

(21) Appl. No.: 15/840,944

(22) Filed: Dec. 13, 2017

(65) Prior Publication Data

US 2018/0100126 A1 Apr. 12, 2018

Related U.S. Application Data

(63) Continuation of application No. 14/185,060, filed on Feb. 20, 2014, now Pat. No. 9,879,206.

(60) Provisional application No. 61/783,829, filed on Mar. 14, 2013.

(51) Int. Cl.
*C11D 3/386* (2006.01)
*C11D 3/00* (2006.01)

(52) U.S. Cl.
CPC ..... *C11D 3/38618* (2013.01); *C11D 3/0042* (2013.01)

(58) Field of Classification Search
CPC ..... C11D 3/046; C11D 3/386; C11D 3/0042
USPC ..... 510/392
See application file for complete search history.

(56) References Cited

U.S. PATENT DOCUMENTS

| | | | |
|---|---|---|---|
| 3,741,901 A | 6/1973 | Ziffer | |
| 4,238,345 A | 12/1980 | Guilbert | |
| 4,421,664 A | 12/1983 | Anderson | |
| 4,715,899 A | 12/1987 | Chanda | |
| 4,797,225 A | 1/1989 | Broze | |
| 5,093,021 A | 3/1992 | Coyne et al. | |
| 5,336,430 A | 8/1994 | Bahary | |
| 5,630,883 A | 5/1997 | Steer | |
| 5,681,803 A | 10/1997 | Okano et al. | |
| 5,696,071 A | 12/1997 | Okutsu et al. | |
| 5,705,469 A | 1/1998 | Blake | |
| 5,710,115 A | 1/1998 | Patel | |
| 5,763,378 A | 6/1998 | Painter | |
| 5,772,786 A | 6/1998 | De Smet | |
| 5,853,430 A | 12/1998 | Shindo | |
| 5,858,117 A | 1/1999 | Oakes et al. | |
| 5,861,366 A | 1/1999 | Ihns et al. | |
| 5,904,161 A | 5/1999 | Rai | |
| 6,197,070 B1 | 3/2001 | Horner | |
| 6,197,739 B1 | 3/2001 | Oakes et al. | |
| 6,368,420 B1 | 4/2002 | Angevaare | |
| 6,489,279 B2 | 12/2002 | Convents | |
| 6,492,316 B1 | 12/2002 | Herbots | |
| 9,879,206 B2 * | 1/2018 | Rischmiller | C11D 3/0042 |
| 2001/0000509 A1 | 4/2001 | Shikata et al. | |
| 2002/0019326 A1 | 2/2002 | Van Dijk | |
| 2002/0037824 A1 | 3/2002 | Smets | |
| 2003/0017959 A1 | 1/2003 | Baeck | |
| 2006/0094634 A1 | 5/2006 | Jekel et al. | |
| 2006/0116309 A1 | 6/2006 | Lambotte | |
| 2006/0122089 A1 | 6/2006 | Lambotte et al. | |
| 2006/0223738 A1 | 10/2006 | Holderbaum et al. | |
| 2007/0054829 A1 | 3/2007 | Gentschev | |
| 2007/0244024 A1 | 10/2007 | Barthel et al. | |
| 2007/0244025 A1 | 10/2007 | Timmann | |
| 2007/0244026 A1 | 10/2007 | Barthel | |
| 2008/0004196 A1 | 1/2008 | Beenen | |

(Continued)

FOREIGN PATENT DOCUMENTS

| | | |
|---|---|---|
| EP | 533239 | 3/1993 |
| JP | 2001064695 | 3/2001 |

(Continued)

OTHER PUBLICATIONS

Hintz, et al., Effects of Sodium Sulfite on Recovery and Composition of Detergent Fiber and Lignin, Journal of AOAC International, vol. 79, No. 1, pp. 16-22 1996.
Zhang et al., SDS-Sulfite Increases Enzymatic Hydrolysis of Native Sorghum Starches, Starch/Starke 51, pp. 21-25 1999.
Chai et al., An Alternative Oven Method Combined with Different Detergent Strengths in the Analysis of Neutral Detergent Fibre, Aniaml Feed Science and Technology 74, pp. 281-288 1998.

(Continued)

*Primary Examiner* — Gregory E Webb

(74) *Attorney, Agent, or Firm* — McKee, Voorhees & Sease, PLC

(57) ABSTRACT

A cleaning composition is provided including an alkalinity source, builder, surfactant, water, a reducing agent and amylase in the ratio of from about 1:1 to about 1:3 wherein the total amount of amylase in the composition is equal to or less than about 1.0 weight percent; and wherein the composition is substantially free of polyols, alkanolamine, phosphates, and boric acid. A method of presoaking soiled substrates is further provided. The method including the steps of providing presoak solution to a soiled substrate at a temperature of between about 65.5° C. up to about 80° C., the presoak solution including the provided composition; draining the presoak solution from the substrate; providing a detergent to a soiled substrate including the composition of the present invention; and removing or draining the detergent; and rinsing the substrate with water.

18 Claims, No Drawings

(56) References Cited

U.S. PATENT DOCUMENTS

| | | | | |
|---|---|---|---|---|
| 2008/0004201 | A1 | 1/2008 | Boutique et al. | |
| 2008/0004202 | A1 | 1/2008 | Wolfgang | |
| 2008/0025960 | A1* | 1/2008 | Kumar ..... | C11D 3/046 424/94.3 |
| 2008/0045434 | A1 | 2/2008 | Barthel | |
| 2008/0248989 | A1 | 10/2008 | Holderbaum | |
| 2008/0045441 | A1 | 11/2008 | Schmiedel et al. | |
| 2008/0276967 | A1 | 11/2008 | Smith et al. | |
| 2009/0029055 | A1 | 1/2009 | Holderbaum et al. | |
| 2009/0069208 | A1 | 3/2009 | Libralesso et al. | |
| 2009/0203088 | A1 | 8/2009 | Baldwin | |
| 2010/0190676 | A1 | 7/2010 | Smith et al. | |
| 2012/0304402 | A1 | 12/2012 | Miracle | |

FOREIGN PATENT DOCUMENTS

| | | |
|---|---|---|
| WO | 1995012652 | 5/1995 |
| WO | 1997042286 | 11/1997 |

OTHER PUBLICATIONS

Ecolab USA Inc., Application No. 14772885.1/PCT/US2014/017290. "Extended European Search Report" 9 pages, dated Oct. 31, 2016.

* cited by examiner

ENZYME-CONTAINING DETERGENT AND PRESOAK COMPOSITION AND METHODS OF USING

RELATED APPLICATIONS

This is a Continuation Application of U.S. Ser. No. 14/185,060 filed Feb. 20, 2014, which claims priority under 35 U.S.C. § 119(e) to U.S. Provisional Application entitled "Enzyme-Containing Detergent and Presoak Composition and Methods of Using", Ser. No. 61/783,829, filed on Mar. 14, 2013, which are incorporated herein by reference in their entireties for all purposes.

FIELD OF THE INVENTION

The invention relates to enzyme-containing warewash and laundry detergent and presoak compositions. In particular, the invention relates to compositions including amylase. The invention relates to a composition that includes reduced amylase concentration yet maintains the cleaning ability as if the concentration were not reduced. The invention provides a booster of a 1:1 ratio of amylase to sodium sulfite. The enzyme activity is heightened with this ratio of booster to enzyme as compared against a comparable amount of enzyme without the booster, or without the sodium sulfite. The invention relates to enzyme-containing formulations in an aqueous composition, a non-aqueous liquid composition, a cast solid, a granular form, a particulate form, a compressed tablet, a gel, a paste and a slurry form. The invention also relates to methods capable of a rapid removal of gross food soils, films of food residue and other minor food or starchy soil compositions.

BACKGROUND

In order to increase the washing or cleaning performance of presoaks or detergent compositions, it has long been known to include enzymes. Enzymes are important and essential components of biological systems, their function being to catalyze and facilitate organic and inorganic reactions. For example, enzymes are essential to metabolic reactions occurring in animal and plant life.

Enzymes are generally simple proteins or conjugated proteins produced by living organisms and functioning as biochemical catalysts which, in detergent technology, degrade or alter one or more types of soil residues encountered on surfaces such as food utensils or textiles thus removing the soil or making the soil more removable by the detergent-cleaning system. Both degradation and alteration of soil residues improve detergency by reducing the physicochemical forces which bind the soil to the surface being cleaned, i.e. the soil becomes more water soluble.

Enzymes are referred to as simple proteins when they require only their protein structures for catalytic activity. Enzymes are described as conjugated proteins if they require a non-protein component for activity, termed cofactor, which is a metal or an organic biomolecule often referred to as a coenzyme. Cofactors are not involved in the catalytic events of enzyme function. Rather, their role seems to be one of maintaining the enzyme in an active configuration. As used herein, enzyme activity refers to the ability of an enzyme to perform the desired catalytic function of soil degradation or alteration; and, enzyme stability pertains to the ability of an enzyme to remain or to be maintained in the active state.

Enzymes are extremely effective catalysts. In practice, very small amounts will accelerate the rate of soil degradation and soil alteration reactions without themselves being consumed in the process. Enzymes also have substrate (soil) specificity which determines the breadth of their catalytic effect. Some enzymes interact with only one specific substrate molecule (absolute specificity); whereas, other enzymes have broad specificity and catalyze reactions on a family of structurally similar molecules (group specificity).

It has long been known to incorporate enzymes into warewash detergents and presoaks in order to increase the washing or cleaning performance of the compositions. Examples of such enzymes include proteases, amylases, lipases, hemicellulases and cellulases. While incorporating enzymes may result in enhanced performance, it also increases the cost of the detergent and/or presoak. Enzymes are generally expensive ingredients as compared to the other components of a warewashing detergent. It would be desirable to reduce the amount of enzyme necessary in a detergent or presoak yet to maintain the enzyme's effectiveness as if it were present in a greater concentration.

The present invention addresses and resolves this and other issues.

SUMMARY

The invention relates to compositions useful in warewashing or laundry including enzymes without the addition of enzyme performance enhancers. In particular, the invention composition includes about 1:1 to about 3:1 ratio of amylase to reducing agent or booster along with an alkalinity source, surfactant, builder and optionally water. Water may be added to the composition if the composition is provided as a liquid. Alternatively, water may be excluded if the composition is provided as a solid such as a block or granular format or as a powder. Compositions of the invention surprisingly do not require additional enzyme stabilizing agents such as alkanolamine or borate to name a couple. Compositions of the invention are provided as phosphate free compositions for sustainability purposes. Compositions of the invention may be used as a presoak for warewashing or laundry. The methods according to the invention provide benefits of improved efficacy of enzyme-containing detergents in treating surfaces, such as ware and laundry without requiring increased amounts of enzymes. Compositions of the invention may further be used as presoaks for warewashing or laundry.

A cleaning composition is provided including an alkalinity source, builder, surfactant, a reducing agent and amylase in the ratio of from about 1:1 to about 1:3 reducing agent: amylase wherein the total amount of amylase in the composition is equal to or less than about 1.0 weight percent; and wherein the composition is substantially free of polyols, alkanolamine, phosphates, and boric acid. The reducing agent included in the composition may be sodium sulfite, sodium metasulfite or combinations thereof. An alkalinity source included in the composition may be comprised of sodium hydroxide, sodium carbonate, sodium sesquicarbonate, or combinations thereof. Exemplary builders suitable for use in the composition include carboxylates, aminocarboxylates, phosphonates or combinations thereof. Surfactants suitable for use in the composition include an anionic or quaternary surfactants.

A composition is provided including 50 to 65 weight percent alkalinity source, 20 to 35 weight percent builder, 2 to 6 weight percent surfactant, 2 to 6 weight percent water, 0.1 to 1 weight percent amylase, and 0.1 to 1 weight percent reducing agent or booster.

A cleaning composition suitable for washing ware or laundry including an alkalinity source, a builder, a surfactant, water, and amylase and an enzyme performance enhancer consisting of a reducing agent wherein the ratio of amylase to reducing agent is in the range of from about 1:1 to about 1:3. In an embodiment, the cleaning composition includes equal to or less than about 0.5 weight percent amylase. In one embodiment, a cleaning composition of the invention is substantially free of polyols, alkanolamine, phosphates and boric acid.

A method of washing substrates wherein the substrates are made up of laundry or wares is provided. The method includes the steps of providing detergent to a soiled substrate at a temperature of between about 65.5° C. up to about 80° C., the detergent including an alkalinity source, a builder, a surfactant, water, and amylase and an enzyme performance enhancer consisting of a reducing agent wherein the ratio of amylase to reducing agent is in the range of from about 1:1 to about 1:3; and rinsing the substrate with water. The method of providing the detergent to soiled substrates lasts up to about 45 seconds.

A method of presoaking soiled substrates is further provided. Such presoaking method includes providing presoak solution to a soiled substrate at a temperature of between about 65.5° C. up to about 80° C., the presoak solution including an alkalinity source, a builder, a surfactant, water, and amylase and an enzyme performance enhancer consisting of a reducing agent wherein the ratio of amylase to reducing agent is in the range of from about 1:1 to about 1:3; removing or draining the presoak solution from the substrate; followed by providing a detergent including an alkalinity source, a builder, a surfactant, water, and amylase and an enzyme performance enhancer consisting of a reducing agent wherein the ratio of amylase to reducing agent is in the range of from about 1:1 to about 1:3 to the soiled substrate; removing or draining the detergent; and rinsing the substrate with water. The method may include a rinse step after the presoak is drained or may exclude a rinse step after draining or removing the presoak. The method of providing the presoak to the soiled substrate lasts up to about 45 seconds, up to about 1 minute, up to about 5 minutes, up to about 10 minutes, and up to about 30 minutes.

Compositions of the invention may be provided in concentrated form or in ready to use form. The diluted concentrate when delivered to the targeted surfaces or substrates will provide cleaning. The concentrate products can be in the form of a liquid or emulsion; a solid, tablet, or encapsulate form; a powder or particulate form; a gel or paste; or slurry. The concentrate products may be manufactured by any number of liquid and solid blending methods known to the art inclusive of casting, pour-molding, compressions-molding, extrusion-molding or similar shape-packaging operations.

The present invention describes detergent and presoak compositions generally containing enzymes, surfactants, alkalinity sources, builders or water conditioning agents, an enzyme stabilizing agent consisting of a reducing agent; and, optionally a variety of formulary adjuvants depending upon product form and application such as (but not limited to) thickeners, solidifiers, hydrotropes, emulsifiers, solvents, antimicrobial agents, fragrances, coloring agents; and, inert organic or inorganic fillers and carriers.

DESCRIPTION

As used herein, the term "phosphate-free" refers to a composition, mixture, or ingredient that does not contain a phosphate or phosphate-containing compound or to which a phosphate or phosphate-containing compound has not been added. Should a phosphate or phosphate-containing compound be present through contamination of a phosphate-free composition, mixture, or ingredients, the amount of phosphate shall be less than 0.5 wt %. More preferably, the amount of phosphate is less than 0.1 wt-percent, and most preferably, the amount of phosphate is less than 0.01 wt %.

As used herein, the term "phosphorus-free" refers to a composition, mixture, or ingredient that does not contain phosphorus or a phosphorus-containing compound or to which phosphorus or a phosphorus-containing compound has not been added. Should phosphorus or a phosphorus-containing compound be present through contamination of a phosphorus-free composition, mixture, or ingredients, the amount of phosphorus shall be less than 0.5 wt %. More preferably, the amount of phosphorus is less than 0.1 wt-percent, and most preferably the amount of phosphorus is less than 0.01 wt %.

"Cleaning" means to perform or aid in soil removal, bleaching, microbial population reduction, rinsing, or combination thereof.

As used herein, the term "ware" includes items such as eating and cooking utensils. As used herein, the term "warewashing" refers to washing, cleaning, or rinsing ware.

As used herein, the term "laundry" includes fabric surfaces, e.g., knit, woven, and non-woven surfaces.

The term "reducing agent" as used herein refers to a chemical which is itself oxidized as it reduces the oxidation state of another chemical. A reducing agent is not a chemical that reduces a microbial load. The term "reducing agent" is used interchangeably herein with the terms "booster" or "performance enhancer" as that is the outcome of including such a component in cleaning or pre-soak compositions.

As used herein, a solid cleaning composition refers to a cleaning composition in the form of a solid such as a powder, a particle, agglomerate, a flake, a granule, a pellet, a tablet, a lozenge, a puck, a briquette, a brick, a solid block, a unit dose, or another solid form known to those of skill in the art. The term "solid" refers to the state of the detergent composition under the expected conditions of storage and use of the solid detergent composition. In general, it is expected that the detergent composition will remain in solid form when exposed to temperatures of up to about 100° F. and greater than about 120° F.

By the term "solid" as used to describe the processed composition, it is meant that the hardened composition will not flow perceptibly and will substantially retain its shape under moderate stress or pressure or mere gravity, as for example, the shape of a mold when removed from the mold, the shape of an article as formed upon extrusion from an extruder, and the like. The degree of hardness of the solid cast composition can range from that of a fused solid block, which is relatively dense and hard, for example, like concrete, to a consistency characterized as being malleable and sponge-like, similar to caulking material.

As used herein, weight percent (wt-%), percent by weight, % by weight, and the like are synonyms that refer to the concentration of a substance as the weight of that substance divided by the total weight of the composition and multiplied by 100.

The term "about," as used herein, modifying the quantity of an ingredient in the compositions of the invention or employed in the methods of the invention refers to variation in the numerical quantity that can occur, for example, through typical measuring and liquid handling procedures used for making concentrates or use solutions in the real world; through inadvertent error in these procedures; through differences in the manufacture, source, or purity of the ingredients employed to make the compositions or carry out the methods; and the like. The term about also encompasses amounts that differ due to different equilibrium conditions for a composition resulting from a particular initial mixture. Whether or not modified by the term "about," the claims include equivalents to the quantities. All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

In the interest of brevity and conciseness, any ranges of values set forth in this specification contemplate all values within the range and are to be construed as support for claims reciting any sub-ranges having endpoints which are real number values within the specified range in question. By way of a hypothetical illustrative example, a disclosure in this specification of a range of from 1 to 5 shall be considered to support claims to any of the following ranges: 1-5; 1-4; 1-3; 1-2; 2-5; 2-4; 2-3; 3-5; 3-4; and 4-5.

The present invention contemplates the possibility of omitting any components listed herein. The present invention further contemplates the omission of any components even though they are not expressly named as included or excluded from the invention.

The term "substantially free" may refer to any component that the composition of the invention lacks or mostly lacks. When referring to "substantially free" it is intended that the component is not intentionally added to compositions of the invention. Use of the term "substantially free" of a component allows for trace amounts of that component to be included in compositions of the invention because they are present in another component. However, it is recognized that only trace or de minimus amounts of a component will be allowed when the composition is said to be "substantially free" of that component. Moreover, the term if a composition is said to be "substantially free" of a component, if the component is present in trace or de minimus amounts it is understood that it will not affect the effectiveness of the composition. It is understood that if an ingredient is not expressly included herein or its possible inclusion is not stated herein, the invention composition may be substantially free of that ingredient. Likewise, the express inclusion of an ingredient allows for its express exclusion thereby allowing a composition to be substantially free of that expressly stated ingredient.

As used herein the term, "consisting essentially of" in reference to a composition refers to the listed ingredients and does not include additional ingredients that, if present, would affect the cleaning ability of the cleaning composition. The term "consisting essentially of" may also refer to a component of the cleaning composition. For instance, a surfactant package may consist essentially of two or more surfactants and such surfactant package would not include any other ingredients that would affect the effectiveness of that surfactant package—either positively or negatively. As used herein the term "consisting essentially of" in reference to a method of cleaning refers to the listed steps and does not include additional steps (or ingredients if a composition is included in the method) that, if present, would affect the cleaning ability of the cleaning method.

These and other aspects, advantages, and salient features of the present invention will become apparent from the following description and the appended claims.

The present invention is useful in preparing and in use as a presoak or prewash, or a cleaning agent for treating a variety of surfaces. Compositions prepared according to the invention are useful in cleaning starch and/or polysaccharide containing soils.

Enzymes

Amylases are examples of enzymes useful in the present invention. Examples of amylases which can be used in accordance with the invention are the α-amylases from *Bacillus licheniformis*, from *B. amyloliquiefaciens* or *B. stearothermophilus* and developments thereof which have been improved for use in washing and cleaning compositions. Novozymes (with corporate offices in New York, N.Y.), and Genencor (a DuPont subsidiary located in Palo Alto, Calif.), sell α-amylases derived from one or all of the above-mentioned bacterial species. Novozymes further offers α-amylase from *Aspergillus niger* and *A. oryzae*.

Compositions of the invention include reduced amounts of amylase compared to other commercially available warewashing detergents or presoaks. Compositions of the invention include up to about 2 weight percent amylase, up to about 1.5 weight percent, up to about 1.0 weight percent, up to about 0.5 weight percent, and up to about 0.1 weight percent amylase.

Since enzymes are proteins, it is important that the other components of the composition not serve to denature the enzyme thus rendering it ineffective for its intended purpose. For compositions of the invention incorporating active enzymes or enzymes otherwise stabilized (such as is the case with bacterial spores capable of producing active enzymes), the pH of the composition becomes important. That is, the pH of a composition of the invention including an enzymatic ingredient should be such that the enzymatic component remains stable and is not denatured. Such a pH may be at or near about neutral pH or between about 6 and 8.

Another consideration when incorporating an enzymatic ingredient into compositions of the invention is the amount of water present. As with pH, water can serve to denature enzymes or germinate a component that may be present as a spore. For compositions including enzymatic components, the amount of water may need to be limited to ensure enzymatic activity remains stable over the shelf life of the composition.

Compositions of the invention include from about 0.1 to about 5 weight percent active enzyme, from about 0.1 to about 4 weight percent, from about 0.1 to 2 weight percent, from about 0.1 to about 1.5 weight percent, from about 0.1 to about 1.0 weight percent, and from about 0.1 to about 0.5 weight percent.

Enzyme-Stabilizing Agent/Reducing Agent/Performance Enhancer

The reducing agent, a sulfite such as sodium sulfite, sodium metasulfite, sodium phosphite, of the composition is the only enzyme-stabilizing agent present in the composition.

It has surprisingly been discovered that the composition of the invention, whether used as a presoak or as a detergent, does not require and is substantially free of additional enzyme-stabilizing agents. Without being bound by theory, it is believed that the addition of sulfite, or similar material, to the invention composition enhances the ability for the amylase to penetrate the starch structure and is effective in the absence of other enzyme-stabilizing agents. This is similar to the technique of acid hydrolysis modification by sulfuric acid. The modification improves the gelling capability of the starch. Such gelling capability results in the starch molecule absorbing extra water. It is believed that the absorption of such extra water allows increased penetration and thereby quicker removal of the starch than with amylase alone.

Compositions of the invention are surprisingly substantially free of polyols, alkanolamine, phosphates and boric acid. These components have been used to stabilize enzymes in detergent compositions or in presoak compositions in the past. Compositions of the invention are substantially free of additional enzyme-stabilizing agents. Examples of enzyme-stabilizing agents that are absent in compositions of the present invention include but are not limited to boric acid, triethanolamine, morpholine, alpha-pyrrolidone, ethylene glycol, succinic acid or other dicarboxylic acids, propylene glycol, glycerol, water soluble calcium salts, glycerol, propylene glycol, fatty acid amine alkoxylates, amino alcohols, polyols, additional divalent cations, or mixtures thereof. However, due to the unique formulation of the present invention and the discovery that a 1:1 to a 3:1 amylase: reducing agent provides both effective cleaning and stabilization of the enzyme it is unnecessary to include additional stabilizing agents into compositions of the invention. Such exclusion of additional ingredients results in cost savings as well as reducing the risk that the components will adversely react with active agents in the compositions.

In compositions of the invention, the enzyme stabilizing agent (reducing agent) is present in an amount from about 1:1 enzyme to enzyme stabilizing agent up to about 3:1 enzyme to enzyme stabilizing agent. Compositions of the invention include from about 0.1 to about 2 weight percent active reducing agent, from about 0.1 to about 1.3 weight percent, from about 0.1 to 0.6 weight percent, from about 0.1 to about 0.5 weight percent, from about 0.1 to about 0.3 weight percent, and from about 0.1 to about 0.2 weight percent.

Alkalinity Agent or Source

Soil removal is most commonly obtained from a source of alkalinity used in manufacturing a cleaning composition. Sources of alkalinity can be organic, inorganic, and mixtures thereof. Organic sources of alkalinity are often strong nitrogen bases. Such suitable sources of organic alkalinity agents include, for example, ammonia (ammonium hydroxide) and amines. Typical examples of amines include primary, secondary or tertiary amines and diamines carrying at least one nitrogen linked hydrocarbon group, which represents a saturated or unsaturated linear or branched alkyl group having at least 10 carbon atoms and preferably 16-24 carbon atoms, or an aryl, aralkyl, or alkaryl group containing up to 24 carbon atoms, and wherein the optional other nitrogen linked groups are formed by optionally substituted alkyl groups, aryl group or aralkyl groups or polyalkoxy groups. However, other organic alkalinity agents such as alkanolamines and amino alcohols are not used in the present composition because they may serve to further stabilize the enzymatic component as discussed above. Typical examples of alkanolamines include monoethanolamine, monopropanolamine, diethanolamine, dipropanolamine, triethanolamine, tripropanolamine and the like. Typical examples of amino alcohols include 2-amino-2-methyl-1-propanol, 2-amino-1-butanol, 2-amino-2-methyl-1, 3-propanediol, 2-amino-2-ethyl-1, 3-propanediol, hydroxymethyl aminomethane, and the like.

Exemplary sources of inorganic alkalinity also include alkali metal hydroxides, alkali metal carbonates, sesquicarbonates, and bicarbonates, and mixtures thereof. Typical examples of alkali metal hydroxides include sodium hydroxide, potassium hydroxide, and lithium hydroxide. Exemplary alkali metal salts include sodium carbonate, potassium carbonate, and mixtures thereof. It is understood that the use of alkali metal hydroxides may be detrimental to the surface intended to be cleaned such as, for example, metal surfaces. When intending to clean delicate metal surfaces prone to corrosion, compositions of the invention should be substantially free of or free of caustic components.

In compositions of the invention, the alkalinity source is present in an amount from about 0.1 to about 80 weight percent. Compositions of the invention include from about 10 to about 40 weight percent, from about 15 to about 40 weight percent, from about 20 to 35 weight percent, from about 35 to about 50 weight percent.

Builder

Another component of the invention composition is a builder. The term "builder" as used herein refers to components of the composition that bind with ions that cause hard water. One skilled in the art will recognize that hardness in water usually consists of calcium ($Ca^{2+}$), magnesium ($Mg^{2+}$) ions and possibly other dissolved compounds such as bicarbonates and sulfates. Although water hardness usually only measures the total concentrations of calcium and magnesium (the two most prevalent, divalent metal ions), iron, aluminum, and manganese may also be present at elevated ppm levels in some geographical locations. In the case of automatic warewashing and laundry machines, the ions causing hard water may be present from the incoming wash water, the soil, or from the substrates being washed. "Builders" as used herein bind with water hardness ions in a specific molar ratio to form water-soluble or insoluble compounds. Some examples of builders that form insoluble compounds include sodium triphosphate (STP) and zeolite A. Some examples of builders forming soluble compounds include sodium tripolyphosphate (STPP), ethylenediaminetetraacetic acid (EDTA), diethylene triamine pentaacetic acid (DTPA), nitrilotriacetate (NTA), and citrate to name a few.

Both organic and inorganic builders can be used. Organic builders include both polymeric and small molecule chelating agents. Organic small molecule chelating agents are typically organocarboxylate compounds or organophosphate chelating agents. These include but are not limited to hydroxycarboxylates, aminocarboxylates, amino acids such as cysteine and histamine to name a couple, salicylic acid and its derivatives, and fumaric acid and fulvic acid. Polymeric chelating agents commonly comprise polyanionic compositions such as polyacrylic acid compounds. Polymers such as Acusol 448 available from Rohm & Haas and others are also useful in the present invention. Small molecule organic chelating agents include sodium gluconate, sodium glucoheptonate, N-hydroxyethylenediaminetriacetic acid (HEDTA), ethylenediaminetetraacetic acid (EDTA), nitrilotriacetic acid (NTA), diethylenetriaminepentaacetic acid (DTPA), ethylenediaminetetraproprionic acid, triethylenetetraaminehexaacetic acid (TTHA), and the respective alkali metal, ammonium and substituted ammonium salts thereof, ethylenediaminetetraacetic acid tetrasodium salt (EDTA), nitrilotriacetic acid and its salts such as nitrilotriacetic acid trisodium salt (NTA), ethanoldiglycine disodium salt (EDG), diethanolglycine sodium-salt (DEG), and 1,3-propylenediaminetetraacetic acid (PDTA), dicarboxymethyl glutamic acid tetrasodium salt (GLDA), methylglycine-N—N-diacetic acid trisodium salt (MGDA), and iminodisuccinate sodium salt (IDS). All of these are known and commercially available. Small molecule organic chelating agents also include biodegradable sequestrants having chelating functionalities from EDG, MGDA and GLDA-type molecules. Other sequestrants include ethanoldiglycine disodium salt (EDG), dicarboxymethyl glutamic acid tetrasodium salt (GLDA), and methylglycine-N—N-diacetic acid trisodium salt (MGDA).

Examples of builders include polycarboxylic acids or salts thereof, sequestering agents and silicates. Examples of polycarboxylic acids include phosphorus or non-phosphorus-containing polycarboxylic acids such as citric acid, tartaric acid, gluconic acid, polyacrylic acid, polymethacrylic acid, polymaleic acid, copolymers or terpolymers of unsaturated carboxylic acids selected from acrylic, methacrylic, maleic, itaconic, ethylacrylic acids or salts thereof. Copolymers or terpolymers may also include monomers containing sulfonic acid groups or salts thereof. Sulfonic acid containing monomers include 2-acrylamido-2-methyl propane sulfonic acid, vinyl sulfonic acid, methylallyl sulfonic acid, sulfonated styrene and allyloxybenzene sulfonic acid. Copolymer or terpolymers may also include vinyl acetate, vinyl propionate, vinyl benzoate and esters or acrylic or methacrylic acids. The copolymers or terpolymers may optionally contain hydrophobic and nonionic monomers including styrene, methylmethacrylate, methylacrylate, C1-C5 vinyl ethers C1-C12 saturated or unsaturated alkyl, C1-C12 saturated or unsaturated hydroxyalkyl C1-C12 alkyl esters and C1-C12 saturated or unsaturated alcohols.

Examples of sequestering agents include but are not limited to acid, ammonium salts or alkali metal salts of N-hydroxyethylaminodiacetic acid, ethylenediaminetetraacetic acid (EDTA), nitrilotriacetic acid (NTA), ethylene diaminedisuccinic acid (EDDS), glutamic acid-N,N-diacetic acid (GLDA), methylglycinediacetic acid (MGDA), hydroxyethyliminodiacetic acid (HEIDA), hydroxyethylenediaminetetraacetic acid, diethylenetriaminepentaacetic acid, N-hydroxyethyl-ethylenediaminetriacetic acid (HEDTA), diethylenetriaminepentaacetic acid (DTPA), 3-hydroxy-2,2'-iminodisuccinic acid (HIDS) and 1,3-diaminopropanetetraacetic acid (1,3-PDTA), 2-phosphonobutane-1,2,4-tricarboxylic acid, 1-hydroxy ethylidene-1,1-diphosphonic acid, amino tri(methylene phosphonic acid), ethylene diamine tetra (methylene phosphonic acid), hexamethylene diamine tetra (methylene phosphonic acid), diethylene triamine penta (methylene phosphonic acid).

Examples of silicates include but are not limited to hydrated or anhydrous alkali metal silicates. Preferred are sodium silicates having a $Na_2O:SiO_2$ ratio from about 1:1 to 1:5.

Compositions of the invention may include a builder in the amount from about 10 to about 60 weight percent, about 10 to about 40 weight percent, from about 20 to about 35 weight percent, from about 25 to about 55 weight percent, from about 35 to about 50 weight percent.

Surfactant

The term "surfactant" or "surface active agent" refers to an organic chemical that when added to a liquid changes the properties of that liquid at a surface. The composition of the invention includes at least one surfactant or surfactant system. A variety of surfactants can be used in a detergent composition, such as anionic, quaternary surfactants. The warewashing detergent composition, can include a surfactant in a range of between about 0.1 wt. % and about 10 wt. %, between about 1 wt. % and about 10 wt. %, between about 2 wt. % and about 8 wt. %, between about 2 wt. % and about 6 wt. %.

Exemplary surfactants that can be used are commercially available from a number of sources. For a discussion of surfactants, see Kirk-Othmer, Encyclopedia of Chemical Technology, Third Edition, volume 8, pages 900-912 incorporated herein for all purposes. When the composition of the invention includes a cleaning agent, the cleaning agent can be provided in an amount effective to provide a desired level of cleaning.

Anionic surfactants useful in the composition of the invention (whether it is a detersive composition, or a pretreatment composition, or a rinse agent composition) includes, for example, carboxylates such as alkylcarboxylates (carboxylic acid salts) and polyalkoxycarboxylates, alcohol ethoxylate carboxylates, nonylphenol ethoxylate carboxylates, and the like; sulfonates such as alkylsulfonates, alkylbenzenesulfonates, alkylarylsulfonates, sulfonated fatty acid esters, and the like; sulfates such as sulfated alcohols, sulfated alcohol ethoxylates, sulfated alkylphenols, alkyl sulfates, sulfosuccinates, alkylether sulfates, and the like; and phosphate esters such as alkylphosphate esters, and the like. Exemplary anionic surfactants include sodium alkylarylsulfonate, alpha-olefinsulfonate, and fatty alcohol sulfates.

Depending upon the intended use, the surfactant can be selected to provide low foaming properties. One would understand that low foaming surfactants that provide the desired level of detersive activity are advantageous in an environment such as a dishwashing machine where the presence of large amounts of foaming can be problematic. In addition to selecting low foaming surfactants, one would understand that defoaming agents could be utilized to reduce the generation of foam. Accordingly, surfactants that are considered low foaming surfactants as well as other surfactants can be used in the warewashing composition and the level of foaming can be controlled by the addition of a defoaming agent.

Water

It should be understood that water provided as part of the invention composition can be relatively free of hardness. It is expected that the water can be deionized to remove a portion of the dissolved solids. If a concentrate is provided, the concentrate is then diluted with water available at the locale or site of dilution and that water may contain varying levels of hardness depending upon the locale. Although deionized is preferred for formulating the concentrate, the concentrate can be formulated with water that has not been deionized. That is, the concentrate can be formulated with water that includes dissolved solids, and can be formulated with water that can be characterized as hard water.

Service water available from various municipalities has varying levels of hardness. It is generally understood that the calcium, magnesium, iron, manganese, or other polyvalent metal cations that may be present can cause precipitation of the anionic surfactant. In general, because of the expected large level of dilution of the concentrate to provide a use solution, it is expected that service water from certain municipalities will have a greater impact on the potential for anionic surfactant precipitation than the water from other municipalities. As a result, it is desirable to provide a concentrate that can handle the hardness levels found in the service water of various municipalities.

The water of dilution that can be used to dilute the concentrate can be characterized as hard water when it includes at least 1 grain hardness. It is expected that the water of dilution can include at least 5 grains hardness, at least 10 grains hardness, or at least 20 grains hardness.

It is expected that the concentrate will be diluted with the water of dilution in order to provide a use solution having a desired level of detersive properties. Alternatively, the composition of the invention is provided as a use solution. When provided as a use solution, water is present in an amount from about 1 weight percent up to about 80 weight percent, from about 20 weight percent up to about 50 weight percent, from about 1 weight percent up to about 10 weight percent, from about 25 weight percent up to about 40 weight percent, from about 2 weight percent up to about 6 weight percent.

Optional Ingredients

Optional ingredients may be included in compositions of the invention. For example, a pH modifier may be supplied by certain acids and bases. Yet other additional optional ingredients include but are not limited to viscosity modifiers, corrosion inhibitors, antiredeposition agents, aesthetic aids, antimicrobial agents, solidification agents, and processing aids. An "antiredeposition agent" refers to a compound that helps keep suspended in water instead of redepositing onto the object being cleaned. Antiredeposition agents are useful in the present invention to assist in reducing redepositing of the removed soil onto the surface being cleaned. Antiredeposition agents may be included up to about 2 wt %, up to about 1 wt %, and up to about 0.5 wt %.

Corrosion inhibitors that may be optionally added to the composition of the invention include silicates, phosphate, magnesium and/or zinc ions. Exemplary silicates include sodium metasilicates, sesquisilicates, orthosilicates, potassium silicates, and mixtures thereof. Corrosion inhibitors may be included up to about 2 wt %, up to about 1 wt %, and up to about 0.5 wt %.

Aesthetic enhancing agents such as colorants and perfume are also optionally incorporated into the concentrate composition of the invention. Examples of colorants useful in the present invention include but are not limited to liquid and powdered dyes from Milliken Chemical, Keystone, Clariant, Spectracolors, Pylam, and Liquitint Violet 0947 commercially available from Milliken Chemical. Colorants may be included up to about 2 wt %, up to about 1 wt %, and up to about 0.5 wt %.

Examples of perfumes or fragrances useful in concentrate compositions of the invention include but are not limited to liquid fragrances from J&E Sozio, Firmenich, and IFF (International Flavors and Fragrances). Fragrances may be included up to about 2 wt %, up to about 1 wt %, and up to about 0.5 wt %.

Preservatives are optional and may be included when the concentrate and use solution pH is not high enough to mitigate bacterial growth in the concentrate. Examples of preservatives useful in compositions of the invention include but are not limited to methyl paraben, glutaraldehyde, formaldehyde, 2-bromo-2-nitropropane-1, 3-diol, 5-chloro-2-methyl-4-isothiazoline-3-one, and 2-methyl-4-isothiazoline-3-one. Preservatives may be included up to about 2 wt %, up to about 1 wt %, and up to about 0.5 wt %.

Delivery Modes

Compositions of the invention may be provided in concentrated form or in ready to use form. The diluted concentrate when delivered to the targeted surfaces will provide cleaning. The concentrate products can be in the form of a liquid or emulsion; a solid, tablet, or encapsulate form; a powder or particulate form; a gel or paste; foam; or a slurry. The concentrate products may be manufactured by any number of liquid and solid blending methods known to the art inclusive of casting, pour-molding, compressions-molding, extrusion-molding or similar shape—packaging operations.

In one embodiment of the invention, the composition is provided as a capsule or pellet of compressed powder, a solid, or loose powder, either contained by a water soluble material or not. In the case of providing the capsule or pellet of the composition in a material, the capsule or pellet can be introduced into a volume of water, and if present the water soluble material can solubilize, degrade, or disperse to allow contact of the composition concentrate with the water. For the purposes of this disclosure, the terms "capsule" and "pellet" are used for exemplary purposes and are not intended to limit the delivery mode of the invention to a particular shape.

In another embodiment, a liquid concentrate composition (other than those suitable for substrate coating) can be diluted through dispensing equipment using aspirators, peristaltic pumps, gear pumps, mass flow meters, and the like. This liquid concentrate embodiment can also be delivered in bottles, jars, dosing bottles, bottles with dosing caps, and the like. The liquid concentrate composition (other than those suitable for substrate coating) can be filled into a multi-chambered cartridge insert that is then placed in a spray bottle or other delivery device filled with a pre-measured amount of water. The liquid concentrate composition (other than those suitable for substrate coating) can also be diluted at the manufacturing site and packaged as a ready-to-use (RTU) use solution.

In yet another embodiment, the concentrate composition can be provided in a solid form that resists crumbling or other degradation until placed into a container. Such container may either be filled with water before placing the composition concentrate into the container, or it may be filled with water after the composition concentrate is placed into the container. In either case, the solid concentrate composition dissolves, solubilizes, or otherwise disintegrates upon contact with water. In a preferred embodiment, the solid concentrate composition dissolves rapidly thereby allowing the concentrate composition to become a use composition and further allowing the end user to apply the use composition to a surface in need of cleaning.

In another embodiment, the solid concentrate composition can be diluted through dispensing equipment whereby water is sprayed at the solid block forming the use solution. The water flow is delivered at a relatively constant rate using mechanical, electrical, or hydraulic controls and the like. The solid concentrate composition can also be diluted through dispensing equipment whereby water flows around the solid block, creating a use solution as the solid concentrate dissolves. The solid concentrate composition can also be diluted through pellet, tablet, powder and paste dispensers, and the like.

EXAMPLES

Soil Preparation

Stainless steel slides were provided and the mass was measured and a reflectance reading (60°) was taken of each clean stainless steel slide. Using hot tap water, a 530 gram solution of 30 grams corn starch in 500 grams tap water was combined in a 600 mL beaker. The starch-water solution was heated using a hot plate while constantly stirring by hand to avoid clumping and burning on the bottom of the beaker. Once the solution came to a boil, it was removed from the heat and covered. The solution was allowed to cool to 75° F. Using a paint brush 2 grams of starch solution was evenly applied to each stainless steel slide. The slides were allowed to set for 2 days. The mass and reflectance readings (60°) were measured and taken for each of the soiled slides.

Presoak Procedure

Presoak solutions were prepared using 5 grain water heated to 140° F. to make 4000 ppm presoak solutions. Stainless steel slides in duplicate were used for each experimental condition. One slide soaked for 10 minutes and one soaked for 30 minutes. At the end of the soak time the slides were rinsed with DI water and placed in a Hobart AM-14 warewash machine for one cycle. The slides were then allowed to dry overnight and mass and reflectance readings (60°) of the cleaned slides were taken.

Example A

A zero phosphorous sodium carbonate-based warewash detergent was tested with 0.1% amylase and 0.1% sodium sulfite. Experiments with the combination did very well in amylase starch testing as compared to testing done with amylase in the absence of sodium sulfite.

Comparative Examples 1 and 4 and Examples 2-3 and 5-6

Using Formulae 1 and 4 provided below as base formulae, different ratios of amylase to sodium sulfite were screened to identify which ratio provided the best starch removal while providing a cost savings. A ratio of 1:1 was discovered to provide starch removal that performed as well as existing compositions while also providing cost savings.

Formula 1, below, is the control presoak formula without amylase, Formula 2 is a control including amylase, and Formula 3 is identical to Formula 2 except with the addition of a reducing agent partially replacing the amylase enzyme. All three formulas were used at 4000 ppm.

| Component | Percent by weight | | |
|---|---|---|---|
| | Formula 1 | Formula 2 | Formula 3 |
| Linear C12-C16 Alcohol 7 Mole Ethoxylate | 4.4 | 4.4 | 4.4 |
| Water, Zeolite Softened | 3.11 | 3.11 | 3.11 |
| ATMP 50%, Low Ammonia | 4.44 | 4.44 | 4.44 |
| NaOH 50% | 3.10 | 3.10 | 3.10 |
| Dye | 0.09 | 0.09 | 0.09 |
| Tart Lemon Fragrance | 0.25 | 0.25 | 0.25 |
| Sodium Carbonate, Intermediate, High Density, Gran. | 21.93 | 20.63 | 21.43 |
| Sodium Tripolyphosphate, Coarse Gran. | 25 | 25 | 25 |
| SODIUM SESQUICARBONATE 2 H2O CRYST. | 37.67 | 37.67 | 37.67 |
| Subtilisin Protease Enzyme | 0.00 | 0.80 | 0.00 |
| Alpha-amylase* | 0.00 | 0.50 | 0.25 |
| Sodium Sulfite | 0.00 | 0.00 | 0.25 |

*Stainzyme 12T available from Novozymes

The following Formulae 4-6 demonstrate the amylase-reducing agent synergy in a presoak formulation. Formula 4 is a formula without amylase, Formulae 5 and 6 are versions of the Formula 4 with amylase and again with the amylase partially replaced with sodium sulfite, respectively. All formulae were used at 4000 ppm.

| Component | Percent by weight | | |
|---|---|---|---|
| | Formula 4 | Formula 5 | Formula 6 |
| Water, Zeolite Softened | 31.14 | 31.14 | 31.14 |
| NaOH 50 Percent Liquid | 0.88 | 0.88 | 0.88 |
| Polyacrylic Acid 46% | 2 | 2 | 2 |
| Dye | 0.06 | 0.06 | 0.06 |
| Sodium Carbonate, Intermediate, High Density, Gran. | 16 | 16 | 16 |
| Sodium Alkyl Benz Sulfonate, 90% Flake | 1.04 | 1.04 | 1.04 |
| Nonylphenol Ethoxylate 9.5 Mole | 4.11 | 4.11 | 4.11 |
| Fragrance | 0.15 | 0.15 | 0.15 |
| Sodium Tripolyphosphate. Large Gran. Hexahydrate | 37.017 | 37.017 | 37.014 |
| Subtilisin Protease Enzyme | 0.16 | 0.16 | 0.16 |
| Sodium Carbonate, Intermediate, High Density, Gran. | 7.10 | 6.10 | 6.10 |
| Alpha-amylase* | 0 | 1 | 0.5 |
| Sodium Sulfite | 0 | 0 | 0.5 |

*Stainzyme 12T available from Novozymes

Formulae 1 and 4 were used as base formulae for each presoak experiment. The indicated amount (0.00%-1.00%) of amylase and/or sodium sulfite was added to each formulae to cover the full range of possible ratios. Each formula was then tested at 4000 ppm, the standard use concentration, in 140° F., 5 grain water by soaking a starch coated stainless steel slide for 10 and 30 minutes. Formula 2 was nearly equivalent to Formula 3 in starch removal and Formula 5 was nearly equivalent to Formula 6 in starch removal. All four Formulae (2, 3, 5, & 6) had significantly higher starch removal than their respective base formulae (1 and 4).

A 1:3 ratio of amylase to sodium sulfite provided significantly less starch removal as compared to amylase alone. A 3:1 ratio of amylase to sodium sulfite provided increased removal of starch as compared to an equivalent amount of amylase alone. Though the 3:1 ratio yielded good performance, it was prohibitively expensive and thus the 1:1 ratio was preferred.

What is claimed:

1. A cleaning composition, comprising:

an alkalinity source, builder, surfactant, water, a reducing agent, and an amylase, wherein the reducing agent and the amylase are present in a ratio of from about 1:1 to about 1:3; wherein the total amount of amylase in the composition is equal to or less than about 1.0 weight percent; and wherein the composition is substantially free of polyols, alkanolamine, phosphates, and boric acid.

2. The composition of claim 1 wherein the reducing agent is comprised of sodium sulfite, sodium metasulfite or combinations thereof.

3. The composition of claim 1 wherein the alkalinity source is comprised of sodium hydroxide, sodium carbonate, sodium sesquicarbonate, or combinations thereof.

4. The composition of claim 1 wherein the builder is comprised of carboxylates, aminocarboxylates, phosphonates, silicates or combinations thereof.

5. The composition of claim 1 wherein the composition further comprises protease.

6. The composition of claim 3 wherein the alkalinity source is sodium carbonate.

7. The composition of claim 1, comprising:

50 to 65 weight percent alkalinity source, 20 to 35 weight percent builder, 2 to 6 weight percent surfactant, 2 to 6 weight percent water, 0.1 to 1 weight percent amylase, and 0.1 to 1 weight percent reducing agent.

8. A cleaning composition, comprising:

an alkalinity source, a builder, a surfactant, water, amylase and an enzyme performance enhancer consisting of a reducing agent, wherein the ratio amylase to reducing agent is in the range of from about 1:1 to about 1:3.

9. The cleaning composition according to claim 8, wherein the total amount of amylase in the composition is equal to or less than about 0.5 weight percent.

10. The cleaning composition according to claim 8, wherein the composition further comprises protease.

11. The cleaning composition according to claim 9, wherein the composition is substantially free of polyols, alkanolamine, and boric acid.

12. The cleaning composition according to claim 8, wherein the ratio of amylase to reducing agent is 1:1.

13. A method of washing wares, comprising the steps of:

a) providing detergent to soiled wares at a temperature of between about 65.5° C. up to about 80° C., the detergent comprising:

an alkalinity source, a builder, a surfactant, water, amylase, and an enzyme performance enhancer consisting of a reducing agent, wherein the ratio amylase to reducing agent is in the range of from about 1:1 to about 1:3; and b) rinsing the ware with water.

14. The method of claim 13 wherein the providing the detergent to soiled wares lasts up to about 45 seconds.

15. A method of presoaking soiled substrates, comprising the steps of:

a. providing presoak solution to a soiled substrate at a temperature of between about 65.5° C. up to about 80° C., the presoak solution comprising an alkalinity source, a builder, a surfactant, water, and amylase and an enzyme performance enhancer consisting of a reducing agent wherein the ratio of amylase to reducing agent is in the range of from about 1:1 to about 1:3;

b. removing or draining the presoak solution from the substrate;

c. providing a detergent to a soiled substrate including an alkalinity source, a builder, a surfactant, water, and amylase and an enzyme performance enhancer consisting of a reducing agent wherein the ratio of amylase to reducing agent is in the range of from about 1:1 to about 1:3 to the soiled substrate;

d. removing or draining the detergent; and e. rinsing the substrate with water.

16. The method of claim 15 further including a rinse step after the presoak.

17. The method of claim 15 wherein the detergent is provided to the substrate immediately following draining the presoak.

18. The method of claim 15 wherein the step of providing the presoak to the soiled substrate lasts up to about 30 minutes.

* * * * *